United States Patent [19]

Pfalzgraf et al.

[11] Patent Number: 4,953,529

[45] Date of Patent: Sep. 4, 1990

[54] LOAD-SHIFTING DEVICE

[75] Inventors: Manfred Pfalzgraf, Frankfurt am Main; Gerd Hickmann, Schwalbach; Eberhard Mausner, Liederbach, all of Fed. Rep. of Germany

[73] Assignee: VDO Adolf Schindling AG, Frankfurt am Main, Fed. Rep. of Germany

[21] Appl. No.: 373,936

[22] Filed: Jun. 28, 1989

[30] Foreign Application Priority Data

Nov. 2, 1988 [DE] Fed. Rep. of Germany ..... 3837162

[51] Int. Cl.[5] ..... F02D 11/10; F02D 41/14

[52] U.S. Cl. ..... 123/396; 123/399; 123/361

[58] Field of Search ..... 123/361, 342, 396, 399, 123/400; 180/197

[56] References Cited

U.S. PATENT DOCUMENTS

| | | | |
|---|---|---|---|
| 4,380,799 | 4/1983 | Allard et al. | 123/396 X |
| 4,419,973 | 12/1983 | Collonia | 123/396 |
| 4,791,902 | 12/1988 | Ishikawa et al. | 123/399 |
| 4,873,957 | 10/1989 | Ueyama et al. | 123/396 X |
| 4,892,071 | 1/1990 | Asayama | 123/396 X |
| 4,896,640 | 1/1990 | Pfalzgraf et al. | 123/399 |

FOREIGN PATENT DOCUMENTS

| | | | |
|---|---|---|---|
| 3146652 | 6/1983 | Fed. Rep. of Germany | 123/399 |

*Primary Examiner*—Willis R. Wolfe

*Attorney, Agent, or Firm*—Martin A. Farber

[57] ABSTRACT

A load-shifting device having a regulating element (11) which can act on a setting member (16) which determines the power of an internal combustion engine, which regulating element is connected to a driver (4) coupled with an accelerator pedal (1). In addition, the regulating element can be moved by means of an electric setting drive (9), having a desired-value detection element (7) associated with the driver (4), and an actual-value detection element (12) cooperating with the driver and acting on the electric setting drive (9). The electric setting drive (9) is adjustable as a function of the detected values by an electronic control device (22). Between the driver (4) and the regulating element (11), a space-monitoring device (15) is provided which, upon a deviation of driver (4) and regulating element (11) from a predetermined spacing established by the control device (22), feeds a signal for the purpose of plausibility testing. The control device (22), in the absence of defined plausibility conditions, uncouples or disconnects the electric setting drive (9), and the driver (4) and control element (11) are mechanically positively guided.

10 Claims, 4 Drawing Sheets

LOAD-SHIFTING DEVICE

FIELD AND BACKGROUND OF THE INVENTION

The invention relates to a load-shifting device for a motor vehicle, the device having a requlating element which can act on a setting member which determines the output of an internal combustion engine, and wherein the regulating element is connected to a driver which is coupled with an accelerator pedal. The regulating element can be moved by means of an electric setting drive, there being a desired-value detection element associated with the driver and an actual-value detection element cooperating with the driver and acting on the electric setting drive, the electric setting drive being regulatable as a function of the values of vehicle and engine speed applied to an electronic control device.

Load-shifting devices of this type are provided in motor vehicles for actuating the throttle valve or the injection pump by the accelerator pedal in order, by means of the electronic regulating device, to be able to intervene in such a manner that, for instance, wheel spinning upon starting as a result of too high a power is avoided. The regulating device provides that, in the event of too rapid a depression of the accelerator pedal, that, for instance, the throttle is opened less than corresponds to the position of the accelerator pedal so that the internal combustion enqine produces merely a power which does not lead to any spinning of the wheels. Other automatic interventions in the load-shifting device are necessary if a transmission is to be switched automatically or if the idling speed of rotation is to be set to a constant value upon idling, even in the event of different power requirements. It is desirable in such a shifting device to intervene by a speed-limiting controller which, by the possibility of uncoupling the control element from the accelerator pedal, provides in each case that power is set which is necessary in order to maintain the speed which has been set. In addition, it may be desirable, in particular from the standpoint of comfort in driving, to provide for a progressive or degressive connection of the accelerator pedal, with the possibility of a power setting which is reduced or increased as compared with the position of the accelerator pedal.

Safety factors, however, make it necessary that, in the event of a defect in the control device, assurance is had that upon a reduction of the position of the accelerator pedal the power setting decreases synchronously with the position of the accelerator pedal. Up to now, this has been achieved by safety devices in the electronic control device. Possibilities of error in the control device are reduced in the manner that the electronics are provided redundantly. Nevertheless, too high a power setting which does not correspond to the position of the accelerator pedal is not completely excluded in the event of a defect.

It is an object of the invention so to develop a load-shifting device of said type in such a manner that the functionability of the electronic regulation of the setting member via the gas pedal and thus the functionability of the electronic control device is continuously monitored and, even in the event of a failure of the electronic control device, a specifically defined reaction on the setting member and consequently on the throttle valve or injection pump is possible.

SUMMARY OF THE INVENTION

Accordingly, the present invention provides that between the driver (4) and the control element (11) there is provided a space-monitoring device (15) which upon a deviation of driver (4) and control element (11) from a predetermined spacing established the control device (22), feeds a signal for the purposes of plausibility testing; in which connection the control device (22), in the absence of well-defined plausibility conditions, uncouples or disconnects the electric setting drive (9), so that the driver (4) and control element (11) are positively moved mechanically.

The space-monitoring device (15), which advisedly cooperates with a safety contact switch (17,15) or includes it, continuously checks the position of driver and regulating element. In the event that specifically defined spacings of driver and control element do not correlate with spacings pre-determined by the state of travel and simultaneously agree with plausibility conditions referred to these states of travel, the space monitoring device conducts the signal for a disconnecting of the electronic control device. Thereby, after the uncoupling or disconnecting of the electric setting drive, the mechanical positive guidance of driver and regulating element takes place. The regulating of the electronic control device by a signal is to be considered in this connection in the sense that both the production of a signal as well as the absence of a signal can be viewed in the sense of an error report for the electronic control device. For example the electronic control device (22) can, in the event of the absence of a switch-contact signal and lack of defined plausibility conditions uncouple or disconnect the electric setting drive (9).

As plausibility conditions there can enter into consideration the most different operating states of the internal combustion engine, for instance states of travel with activated speed-limiting controller, with anti-slip control, etc. In all of these states of travel the electronic control device is fed a signal which actually would indicate a defect in the system but, due to the fact that the plausibility condition is satisfied, does not lead to an uncoupling or disconnecting of the setting member. This takes place thus only when a signal is given off to the control device and the corresponding plausibility conditions are not satisfied; in this case, driver and regulating element are then mechanically positively guided.

Within the scope of the solution proposed in accordance with the invention, operation of the load-shifting device can be varied with respect to its performance within a large range. Thus, for instance, the driver (4) can directly operate the space-measuring device (15), and the driver (4) and the regulating element can be coupled by means of a coupling spring (24), the regulating element (11) being urged in the direction of a stop (14) of the driver (4). Driver and regulating element thus act directly together and, in this connection, the safety contact circuit which cooperates with the space-monitoring device can be positioned at a place which is independent of the space-monitoring device, for instance between the electric setting drive and the setting member.

One particular embodiment of the invention provides, however, that the safety contact circuit (15) have two safety contacts (39,33; 40,34,35,36), in which connection, when the electric setting drive (9) is activated, one safety contact (39,33) monitors the idling range of the internal combustion engine and the other safety contact (40,34,35,36) monitors the partial-load and full-load ranges, and both safety contacts (39,33; 40,34,35,36), are activated in the transition region from idling operation to partial-load operation. Said development of the safety contact circuit has the advantage that during normal travel the safety contacts are actuated alternately and, on basis of the alternate actuation, a continuous monitoring of the electronic control device with regard to its operation is possible.

A voltage supply path (32) should advantageously be provided for both safety contacts (39,33; 40,34,35,36), as well as a first voltage path (33) which leads from the one safety contact (39,33) to the control device (22) and a second voltage path (36) leading from the other safety contact (40,34,35,36) to the control device (22). In this connection, a contact element (38,39,40,34,35) can be connected to the voltage supply path (32) and, on the one hand, the voltage path (33) extending over the idling range for the one safety contact (39,33) and, on the other hand, to the voltage path (36) for the other safety contact (40,34,35,36) extending over the partial-load-full-load region. By such a development of the load-shifting device in the region of the safety contact circuit, assurance is had that, at little structural expense and with little sapce required, the desired switch functions can take place.

In principle, the space-monitoring device and/or the safety contact circuit (15) can be associated both with the control element (11) and with the driver (4).

In both variants it is considered advisable for a spring element (4a,4b,4c,4d) which is limited in path and prestressed in the direction of the control lever (11) to be connected to the driver (4), its spring force being greater than that of the coupling spring (24) but less than the spring force of a return spring (6) which urges the driver (4) in the idling direction. With it, particularly with the setting drive uncoupled or disconnected, in other words in emergency operation, defined positions of driver and control element can be obtained and checked as to plausibility conditions via the safety contact circuit.

In the event that the safety contact circuit is associated with the regulating element, a special embodiment of the invention provides that the driver (4) have a safety contact (34) which is contacted by a safety contact (40) connected to the regulating element (11) in a given spacing range between driver (4) and regulating element (11), and is opened upon a movement of driver (4) and regulating element (11) toward each other. The safety contact (34) of the driver (4) forms a unit with another safety contact (35) which can be brought into contact with the voltage path (36) for the partial-load/-full-load region. In this case, with the setting drive (9) uncoupled or disconnected, the safety contact (40) of the regulating element (11) contacts the safety contact (34) of the driver (4) as a result of the action of the spring element (4a,4b,4c,4d) connected to the driver (4).

In the event that the safety contact circuit is associated with the driver, a special embodiment of the invention provides that the driver (4) has three safety contacts (35,38,39), in which case two safety contacts (38,39) which form a unit can be contacted with the voltage supply path (32) and the voltage path (33) which extends over the idling range. The third safety contact (35) can be contacted with the voltage path (36) to extend over the partial-load/full-load range and be connected via a switch (42) with the voltage supply path (36). In this connection, a switch element (44) which is mounted in the driver (4) and moveable in the direction of movement of the driver (4) is provided which, upon resting against the regulating element (11) or a stationary stop (48) which limits the idling range, switches the switch (42).

The above makes it clear that, in the case of the load-shifting device of the invention, it is of particular importance that all elements of the load-shifting device which act on the regulating element via an electronic circuit be de-activated upon a failure of the electrical system so that the load-shifting device operates solely mechanically as a result of a mechanical positive guidance of driver and regulating element. Thus it is provided that the control electronics are disconnected in the voltage-free condition of the load-shifting device. The same applies to the electric setting drive, which should advisedly be adapted to be coupled via a clutch with the regulating element; the clutch should be opened in the voltage-free state of the electric-setting drive. In principle, however, it is not necessary for a clutch to be provided. In the case of a direct coupling of the electric setting drive with the regulating element, the further return springs would then, however, have to be made so strong that, in the event of a failure of the electronic control device they can move the electric setting drive, whereby reactions on the driver and the accelerator pedal cannot be excluded.

BRIEF DESCRIPITION OF THE DRAWINGS

With the above and other objects and advantages in view, the present invention will become more clearly understood in connection with the detailed description of preferred embodiments, when considered with the accompanying drawings, of which:

FIG. 3b is a section through the region of the space-monitoring device shown in FIG. 3a, along the line 3b—3b of FIG. 3a.

DETAILED DESCRIPTION OF THE PREFERRED EMBODIMENTS

Figure 1:
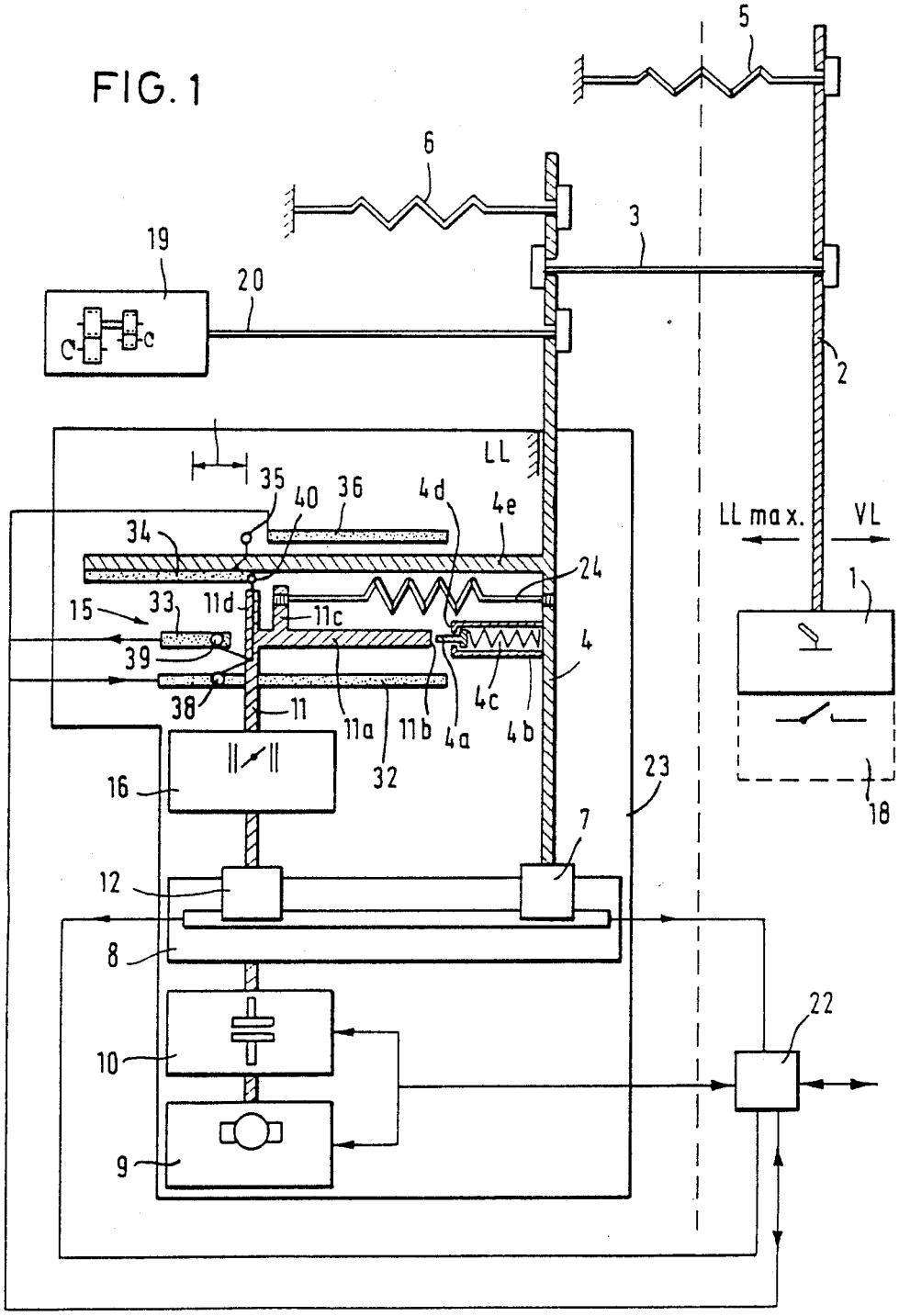
FIG. 1 is a block diagram of a first embodiment of the load-setting device of the invention, having a space-monitoring device associated with the regulating element.

FIG. 1 shows an accelerator pedal 1 by which a lever 2 can be displaced between a full-load stop VL and an idling stop LL. The lever 2 is capable, via a gas pull 3, of shifting a driver 4 in the direction of another full-load stop VL and is urged in idling direction by a return spring 5 which acts on the gas pull 3. A return spring 6 acting on the driver 4 urges the latter in the idling direction. The driver 4 is connected to a desired-value detection element in the manner of a wiper 7 of a potentiometer 8 which controls a servomotor 9 which is capable of shifting a regulating element 11 via a clutch 10. The regulating element 11 serves directly for shifting a throttle valve 16 or a fuel injection. The position of this regulating element 11 is transmitted to the potentiometer 8 via an actual-value detection element in the manner of a second wiper 12 which is firmly connected to said regulating element. If the regulating element 11 precisely follows the command given by the accelerator pedal 1, then the spacing between the wipers 7 and 12 remains constant.

An electronic control device 22, which, inter alia, regulates the electric servomotor 9 and the clutch 10, cooperates with the wipers 7 and 12 of the potentiometer 8. Due to the possibility of representing external predetermined values by the control device 22, the regulating element 11 can be moved independently of the driver 4.

Between the driver 4 and the regulating element 11, there is a positive mechanical guidance. For this purpose, the regulating element 11 has an arm 11*a* which is directed in the direction of the driver 4 and the free end 11*b* of which cooperates with a driver-side ram 4*a*. The latter is held in sleeve 4*b* which is connected to the driver and in which there is guided a compression spring 4*c* which urges the ram 4*a* in the direction toward a stop 4*d* of the sleeve 4*b*. Parallel to the arm 11*a* of the regulating element 11, the driver 4 has an arm 4*e*. Between an extension 11*c* connected to the regulating element 11 and directed toward the driver-side arm 4*a*, adjacent to the sleeve 4*b*, a coupling spring 24 is arranged. The spring forces of the return spring 6, the coupling spring 24 and the compression spring 4*c* are, in this connection, so dimensioned that the pulling force of the return spring 6 is greater than the pushing force of the compression spring 4*c* which, in its turn, is greater than the pulling force of the coupling spring 24.

A space-monitoring device 15 for the driver 4 and the regulating element 11 is associated with the regulating element 11. It comprises a safety contact circuit by which the position of the regulating element 11 with respect to the instantaneous state of travel of the vehicle driven by the internal combustion engine can be checked for plausibility conditions. This is accomplished by feeding a signal to the electronic control device 22, as indicated by the arrows and, in the absence of the signal and certain plausibility conditions, the electric servomotor 9 is uncoupled by the clutch 10. The load-shifting device thus operates exclusively mechanically, i.e., on the basis of the mechanical coupling of driver 4 and regulating element 11 via the compression spring 4*c*, the driver-side ram 4*a* and the arm 11*a*.

In detail, the safety contact circuit has a voltage supply path 32 which extends parallel to the direction of movement of the arms 4*a* and 11*a* and extends over the entire load range of the load-shifting device, as well as a contact path 33, arranged parallel to this, for a first safety contact which extends only over the idling range and, with slight extension to the parallel-load range. Finally, the arm 4*e*, on the side thereof facing a further extension 11*d* of the regulating element 11, has, parallel to the voltage supply path 32, a contact path 34 which extends over the idling range. This contact path 34 forms a unit with a contact element 35 which can contact a contact path 36 which covers the partial-load/full-load region and is arranged parallel to the contact path 32, the contact path 36 extending to overlap with the contact path 33 slightly into the idling region. The extension 11*d* of the regulating element 11 finally has three contact elements 38, 39 and 40, which are connected in electrically conductive manner with each other, the contact element 38 contacting the voltage supply path 32 and, in the same manner, the contact element 39 in the idling range contacts the voltage path 33 and the contact element 40 arranged in the end point of the regulating element 11 can contact the contact path 34 in the partial-load/full-load range.

Starting from the maximum idling position shown in FIG. 1, this means that, with the proper operation of the load-shifting device and in the presence of pre-determined plausibility conditions, one of the contact paths 33 and 36 is provided with current over the voltage supply path 32. Thus, uup to the maximum idling position, the contact element 39 contacts the contact path 33; upon transition to partial-load operation, the contact path 36 is also fed with current as as result of the continuous contact between the contact 40 and the contact path 34. When this is taking place, the contacting of the contact path 33 terminates and exclusively the contact path 36 is contacted by the contact element 40 until the full-load position is reached.

On the basis of the development of the load-shifting device which has been described, the following plausibilities can be continuously checked:

Plausibility between driver 4/wiper 7 (desired value) and voltage supply path 32/contact element 38/contact element 40/contact path 34/contact element 35/contact path 36

Plausibility between control element 11/wiper 12 (actual value) and voltage supply path 32/contact elements 38,39/contact path 33

Plausibility between driver 4/wiper 7 (desired value) and control element 11/wiper 12 (actual value) via voltage supply path 32/contact elements 38,39/contact path 33 and voltage supply path 32, contact element 38,40/contact path 34/contact element 35/contact path 36

Plausibility between driver 4 and control element 11 via voltage supply path 32/contact elements 38,39/contact path 33 and voltage supply path 33/contact element 38,40/contact path 34/contact element 35/contact path 36.

The last mentioned plausibility is in this connection maintaind with the clutch opened, i.e. in emergency operation, by the pre-stressed compression spring 4*c*. It prevents the coupling spring 24 from switching in emergency operation (contact element 40 on contact path 34). In emergency operation therefore, for instance on jamming of the regulating element 11, a switching process activates contact element 40 on contact path 34 (for instance for ignition, etc.).

In travel operation, consideration is given to the construction of the load-shifting device and the development of the safety contact circuit, to the continous alternation of contact leads to a continous checking of the operation of the electronically controlled load-shifting device. Should both contact paths ever be without current and plausibility conditions are not present, then this leads to a disconnecting of the electronic control device, whereby the load-shifting device is operated further mechanically or, depending on the condition of operation, the ignition or injection is adjusted to desired states of operation.

Special conditions of travel under which the plausibility conditions are satisfied result from the particular construction of the load-shifting device of the invecntion. Thus, for instance, in the case of the anti-slip control in which, due to the regulating command of the electronic control device, the servomotor 9 moves the regulating element 11, independently of the position of the driver 4 pre-determined by the travel command, in the idling direction against the force of the coupling spring 24 away from the arm 4e and the ram 4a of the driver 41, in which connection, in this case, the plausibility connection for the electric control device results on basis of the recognition of impending wheel slippage at measurement points in the regions of the wheels. Furthermore, for the case of speed-limiting control at full load, in which the regulating element 11 is moved by engagement of the electric servomotor so far in the direction of full load that the contact element 40 no longer contacts the contact path 34 and thus the contact path 36 is also not contacted. Here also, the electronic control device recognizes the presence of the plausibility condition since the travel command of the speed-limiting control was given to it.

By the frame 23 shown in FIG. 1, there is indicated that the parts contained within the frame represent a single structural unit.

In the event that, after the release of the accelerator pedal 1, the driver 4 and the regulating element 11 cannot be displaced in the direction of idling, a pedal contact switch 18 is provided on the accelerator pedal 1 by which such a condition can be noted. For the sake of completeness, an automatic pull 20 of an automatic transmission 19 by which the driver 4 can alsobe displaced, has been shown in FIG. 1.

Figure 2:
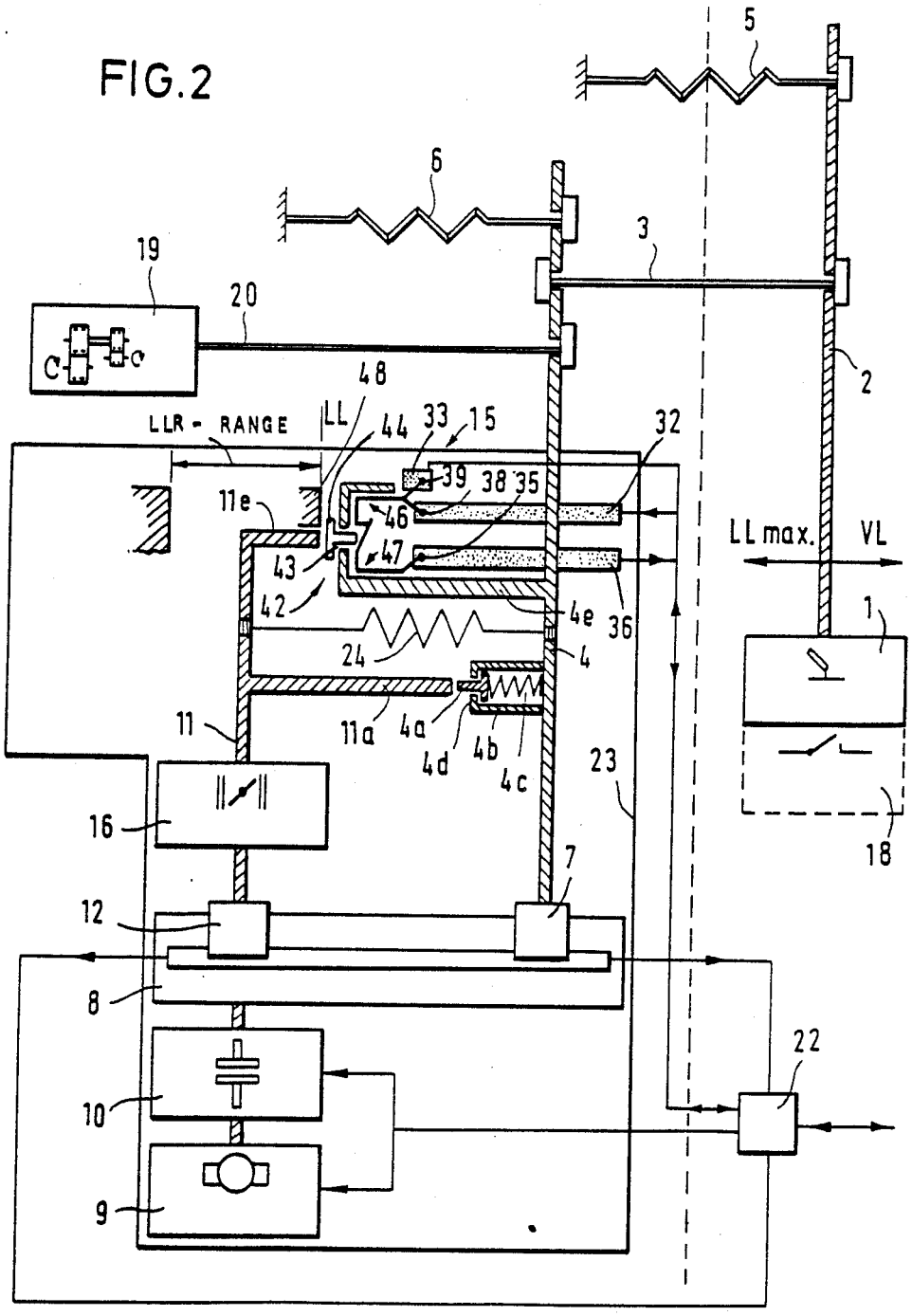
FIG. 2 is a block diagram of as second embodiment, having a space-monitoring device associated with the driver.
Figure 3A:
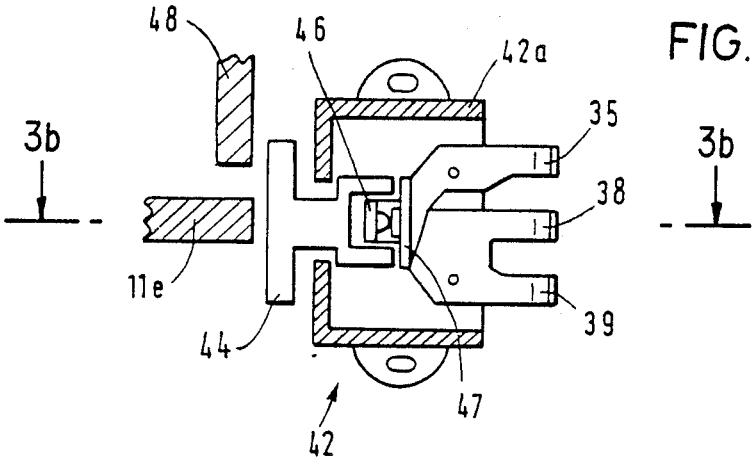
FIG. 3a is a detailed showing of the space-monitoring device, in the region of the switch, shown in FIG. 2, which is associated with the driver.
Figure 3B:
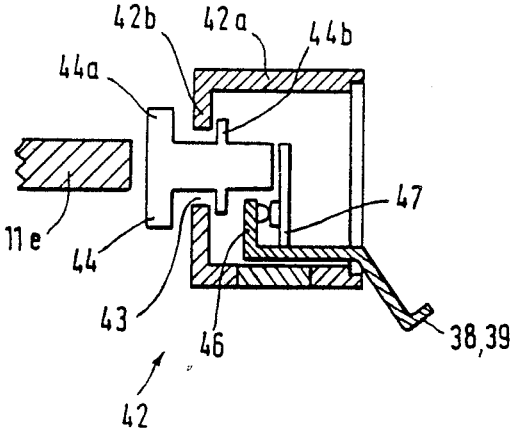

The embodiment shown in FIGS. 2 and 3a, 3b agrees in its operation, referred generally to the load-shifting device, substantially with the embodiment shown in FIG. 1. Accordingly, parts agreeing in their function with the showing in FIG. 1 have been provided, for the sake of simplicity, with the same reference numbers.

The embodiment shown in FIGS. 2 and 3a, 3b differs from the embodiment previously described in the manner that now the space-monitoring device 15 is associated with the driver 4. Thus the stationary voltage supply path 32 and the stationary contact path 33 and 36 are arranged in the region of the driver 4 and extend parallel to the arm 4e of the driver 4. The arm 4e receives, on its free end, a switch 42 which is rigidly connected to it. Its switch support is provided at the center with an opening 43 within which a ram 44 is mounted for displacement in the direction of travel of regulating element 11 and driver 4. A non-spring-actuated contact plate 46 is guided with the contact elements 38 and 39 on the voltage supply path 32 and the contact path 33. A spring-actuated contact plate 47 is guided with the contact element 35 on the contact path 36.

As previously described, the voltage supply path 34 is at operating voltage and the contact paths 33 and 36 are led to the electronic control device. The contact paths 33 and 36 overlap againg, slightly at one side, at the place of separation from idle range to partial-load range, so that upon travel over this operating point in the direction toward downward or upward regulation, the safety contact circuit is checked each time. In addition, when downward regulation takes place into the idling range (no actuation of the gas pedal), a checking of the switch 42 takes place since in the path of movement of the ram 44, a stop 48 extends into the position of the maximum idling position, against which stop the ram 44 strikes and, by displacement in the direction of the driver 4, lifts the spring-actuated contact plate 47 off from the non-spring actuated contact plate 46 and thus opens the switch 42. In the case of the speed-limiting control, the servomotor 9 moves the regulating element 11 as well as another arm 11e acting as ram which is connected with it and arranged parallel to the arm 11a in the direction VL and, by action on the ram 44, also opens the switch 42. The safety contact circuit is bridged over in this connection by the electronic control device 22 and checks switch 42 for proper opening. In case of an emergency and thus with the clutch 10 open, the emergency position is assured by the compression spring 4c, the ram 4a and the arm 11a. In the case of normal operation (large $LL_{max}$), the switch 42 is not switched since the regulating element 11, guided electrically, follows behind the driver 4.

FIGS. 3a and 3b show a switch housing 42a the opening 43 of which introduced into base plate 42b of the switch 42 is passed through by the ram 44 which is guided between two annular flanges 44a and 44b in the base plate 42b. The two figures show the switch 42 in its closed condition.

Figure 4:
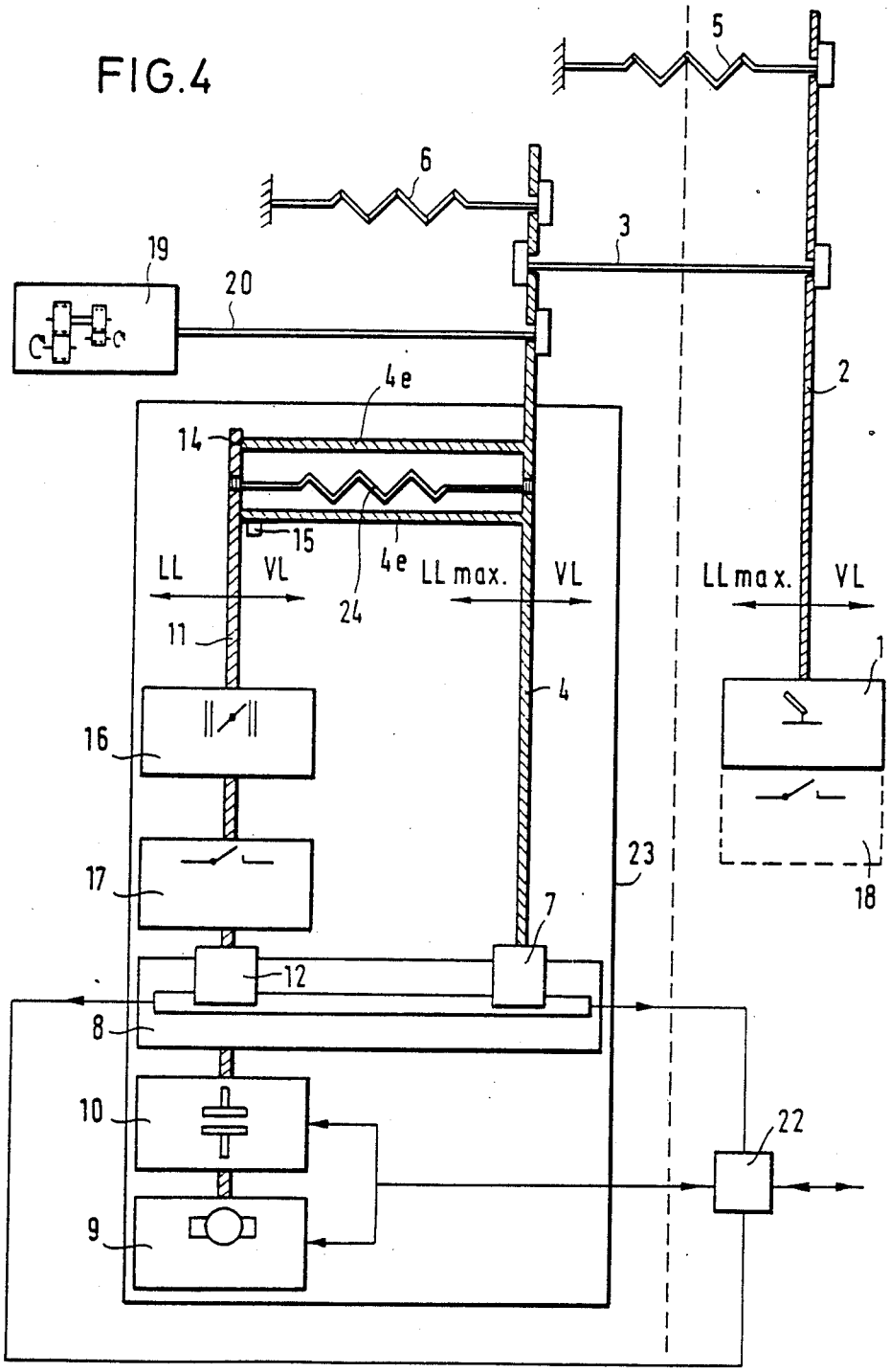
FIG. 4 is a block diagram of another embodiment of a load-shifting device in accordance with the invention.

FIG. 4 shows another embodiment of the load-shifting device of the invention which corresponds in its basic construction to the embodiments shown in FIGS. 1 and 2. Parts agreeing in their function with the showing in FIGS. 1 and 2 have, again, for the sake of simplicity, been provided with the same reference numbers. In the case of the embodiment shown in FIG. 4, the two arms 4e of the driver 4 come directly to rest against the regulating element 11, the driver 4 and the regulating element 11 being coupled by the coupling spring 24 developed as tension spring. The coupling spring 24 is provided for the event of the failure of the electronic control device 22; it urges a control lever of the regulating element 11 in the direction towards a stop 14 of the driver 4. Upon electronic adjustment of the regulating element 11, the driver 4, which is positively guided by the accelerated pedal 1, and the regulating element 11, which is positively guided by the servomotor 9, are at a slight distance from each other which is monitored by the space-monitoring device 15 which, in the case of this embodiment, can be a simple limit switch.

If the electronic system fails, then the driver, after overcoming the slight distance between the stop 14 and the regulating element 11 can shift the latter into the idling position by means of the force of the return spring 6. In this embodiment, a safety contact 17 cooperates with the clutch 10. Thus, a slight reduction in distance is already an indication that the throttle valve 16 has opened further than corresponds to what has been determined by the driver of the vehicle. This fact is noted by the space-monitoring device 15 with the result that the safety contact 17 opens, which leads to the opening of the clutch 10. If, on the other hand, contrary to the desire of the driver of the vehicle, an upward-regulating load function is desired and the plausibility condition is fulfilled, for instance upon an activation of the speed-limiting controller, a de-activation of the space-monitoring device 15 takes place so that the control lever 11 can carry the driver 4 along in full load direction without the safety contact 17 opening.

Reference numerals have been employed to reference some elements of the claims to facilitate identification of elements by way of example. However it is to be understood that these reference numerals are not intended to limit the meaning of the terms and that equivalent means and structures may be employed in the practice of the invention.

We claim:

1. A load-shifting device for a motor vehicle, the device having a regulating element for acting on a setting member which determines the output of an internal combustion engine, the load shifting device comprising a driver which is coupled to an accelerator pedal of the motor vehicle;

an electric setting drive with a desired-value detection element and an actual-value detection element operatively coupled to the electric setting drive;

an electronic control device, the electric setting drive being regulatable as a function of vehicle and engine speed values applied to the electronic control device;

a regulating element, a control device, and a space-monitoring device connected between the driver and the regulating element and wherein said space-monitoring device, upon a deviation of said driver and said regulating element from a predetermined spacing established by the control device, feeds a space signal for the purposes of plausibility testing; and said control device, in the absence of well-defined plausibility conditions, uncouples the electric setting drive allowing said drive and said control element to be move positively mechanically.

2. A load-shifting device according to claim 1, further comprising a coupling spring, and a stop located on said driver; and wherein the driver directly interacts with the space-measuring device, and the driver and the regulating element are coupled by means of the coupling spring, the regulating element being urged in the direction of the stop of the driver.

3. A load-shifting device according to claim 2, wherein said space-measuring device comprises a first and a second safety switch; and upon actuation of said electric setting drive, said first safety switch monitors the idling range of the internal combustion engine and said second safety switch monitors the partial-load and full-load ranges, both said safety switches being activated in a transition region from idling operation to partial-load operation.

4. A load-shifting device according to claim 2, further comprising a return spring which urges said driver in the idling direction; and a spring element which is limited in path and prestressed in the direction of the control lever of the regulating element for connection to the driver, a spring force of said spring element being greater than that of said coupling spring but less than a spring force of said return sring.

5. A load-shifting device according to claim 1, wherein said space-monitoring device comprises a safety contact switch operatively connected to said driver.

6. A load-shifting device, according to claim 5, wherein said space-measuring device comprises a first and a second safety switch; and upon actuation of said electric setting drive, said first safety monitors the idling range of the internal combustion engine and said second safety switch monitors the partial-load and full-load ranges, both said safety switches being activated in a transition region from idling operation to partial-load operation.

7. A load-shifting device according to claim 6, further comprising a supply voltage path, a first voltage path, and a second voltage path; and wherein the supply voltage path connects with both safety switches, said first voltage path connects from said first safety switch to said control device, and said second voltage path connects from said second safety switch to said control device, the first voltage path extending over the idling range for said first safety switch, and said second voltage path extending for said second safety switch over the partial-load/full-load region of vehicle operation.

8. A load-shifting device according to claim 7, further comprising a return spring which urges said driver in the idling direction; and a spring element which is limited in path and prestressed in the direction of the control lever of the regulating element for connection to the driver, a spring force of said spring element being greater than that of said coupling spring but less than a spring force of said return spring.

9. A load-shifting device according to claim 8, wherein said second safety switch comprises a first, a second, a third, and a fourth contact, the first contact (34) being carried by said driver, and the second contact (40) being carried by said regulating element, said first contact (34) contacting said second contact (40) in a given spacing range between driver and regulating element, said spacing being opened upon a movement of driver and regulating element toward each other;

the first contact (34) forms a unit with the third contact (35) which is carried by said regulating unit, the third contact being movable and in contact with the second voltage path (36) in a partial-load/full-load region; and upon an uncoupling of the setting drive, the second contact (40) contacts the first contact (34) as a result of the action of the spring element.

10. A load-shifting device according to claim 9, further comprising a third switch (42) connected between the regulating element and the driver; and said first switch has contacts (38,39) which form a unit to make contact with the supply voltage path and the first voltage path which extends over the idling range; and the third contact (35) of the second switch contacts the second voltage path (36) which extends over the partial-load/full-load range and to connect via the third switch (42) with the second voltage path (36); and wherein the load-shifting device further comprises and a fourth switch (44) which is mounted in the driver and moveable in the direction of movement of driver; the fourth switch (44) has a stop (48) which, upon resting against the regulating element, limits the idling range by switching the third switch (42).

* * * * *